US008826925B2

(12) United States Patent
Pei

(10) Patent No.: US 8,826,925 B2
(45) Date of Patent: Sep. 9, 2014

(54) AUTOMATIC CLEANING APPARATUS

(75) Inventor: Shao-Kai Pei, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 1013 days.

(21) Appl. No.: 12/835,703

(22) Filed: Jul. 13, 2010

(65) Prior Publication Data

US 2011/0035890 A1 Feb. 17, 2011

(30) Foreign Application Priority Data

Aug. 17, 2009 (CN) ..... 2009 1 0305689

(51) Int. Cl.

| | |
|---|---|
| ***B08B 3/02*** | (2006.01) |
| ***B08B 3/04*** | (2006.01) |
| ***B08B 3/08*** | (2006.01) |
| ***B08B 5/02*** | (2006.01) |
| ***B08B 11/02*** | (2006.01) |
| ***B08B 3/10*** | (2006.01) |

(52) U.S. Cl.

CPC . *B08B 3/04* (2013.01); *B08B 11/02* (2013.01); *B08B 3/10* (2013.01); *Y10S 134/902* (2013.01)

USPC ..... 134/143; 134/49; 134/61; 134/66; 134/82; 134/95.2; 134/140; 134/186; 134/200; 134/902

(58) Field of Classification Search

USPC ..... 134/2, 26, 48–49, 61, 66–72, 82, 95.2, 134/102.3, 124–131, 140, 143, 186, 200, 134/902

See application file for complete search history.

(56) References Cited

U.S. PATENT DOCUMENTS

| | | | | |
|---|---|---|---|---|
| 6,158,449 | A * | 12/2000 | Kamikawa | 134/61 |
| 6,394,110 | B2 * | 5/2002 | Kamikawa et al. | 134/61 |
| 6,575,178 | B1 * | 6/2003 | Kamikawa | 134/88 |
| 2002/0121435 | A1 * | 9/2002 | Volodarsky et al. | 204/224 R |
| 2005/0039776 | A1 * | 2/2005 | Yi et al. | 134/2 |
| 2005/0091871 | A1 * | 5/2005 | Yi et al. | 34/275 |
| 2006/0101866 | A1 * | 5/2006 | Kim et al. | 68/3 R |
| 2006/0237033 | A1 * | 10/2006 | Yi et al. | 134/2 |
| 2006/0266386 | A1 * | 11/2006 | Cho et al. | 134/63 |

FOREIGN PATENT DOCUMENTS

| | | |
|---|---|---|
| TW | 193348 | 10/1992 |
| TW | 391895 | 6/2000 |

* cited by examiner

*Primary Examiner* — Joseph L Perrin
*Assistant Examiner* — Levon J Shahinian
(74) *Attorney, Agent, or Firm* — Novak Druce Connolly Bove + Quigg LLP

(57) ABSTRACT

An exemplary cleaning apparatus includes a cleaning member, a connecting member, a drying member, and a workpiece holder. The connecting member includes a main housing defining two opposite surfaces and two blocks received in the main housing. The main housing defines a first chamber and two second chambers communicating with the first chamber, each of the second chambers extending through to one of the two opposite surfaces and near to the other opposite surface. The cleaning member and the drying member are connected to the two opposite surfaces and communicate with each other via the first chamber. The two blocks are movable between the first chamber the second chambers, respectively. Each block defines an engaging surface, facing the other engaging surface. When the blocks move into the first chamber and the engaging surfaces engage with each other, the blocks shut off communication between the cleaning member and the drying member.

10 Claims, 7 Drawing Sheets

AUTOMATIC CLEANING APPARATUS

BACKGROUND

1. Technical Field

The present disclosure relates to automatic cleaning apparatuses and, more particularly, to an apparatus that cleans and dries workpieces automatically.

2. Description of the Related Art

It is common to use a substrate to hold a lens during lens treatment processes such as spraying, ion sputtering, vapor deposition, or spray pyrolysis. After much repeated use, the substrate typically becomes dirty, and is liable to adversely affect the quality of the lens being treated. To restore the substrate to its original condition, it may first be cleaned with fluid and then dried. Generally, the substrate is cleaned in a first housing and transported into a second housing to be dried. The first housing and the second housing are arranged separately and take up much space.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the automatic cleaning apparatus. Moreover, in the drawings, like reference numerals designate corresponding parts throughout the several views.

DETAILED DESCRIPTION

Figure 1:
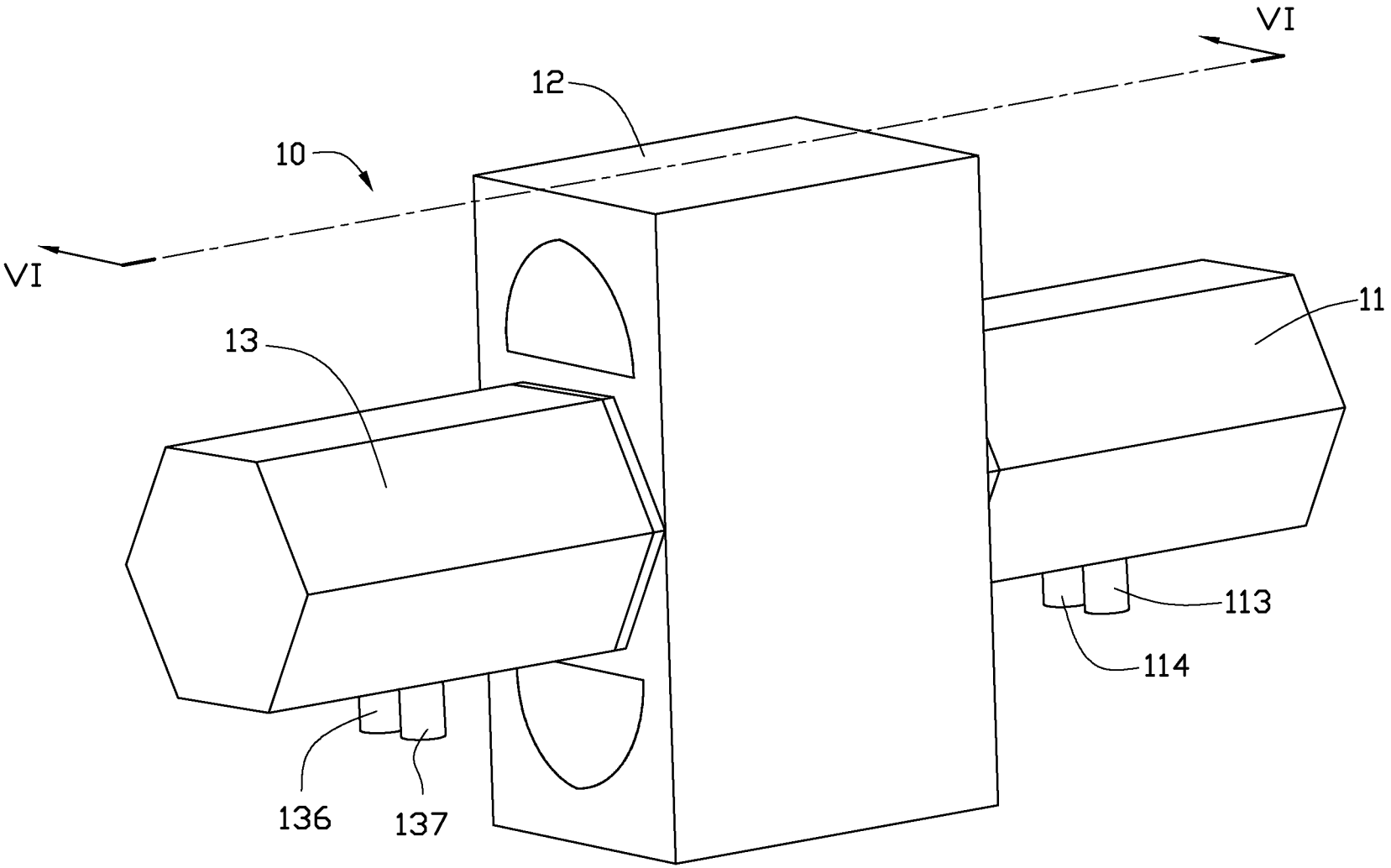
FIG. 1 is an isometric view of an automatic cleaning apparatus according to an exemplary embodiment.
Figure 3:
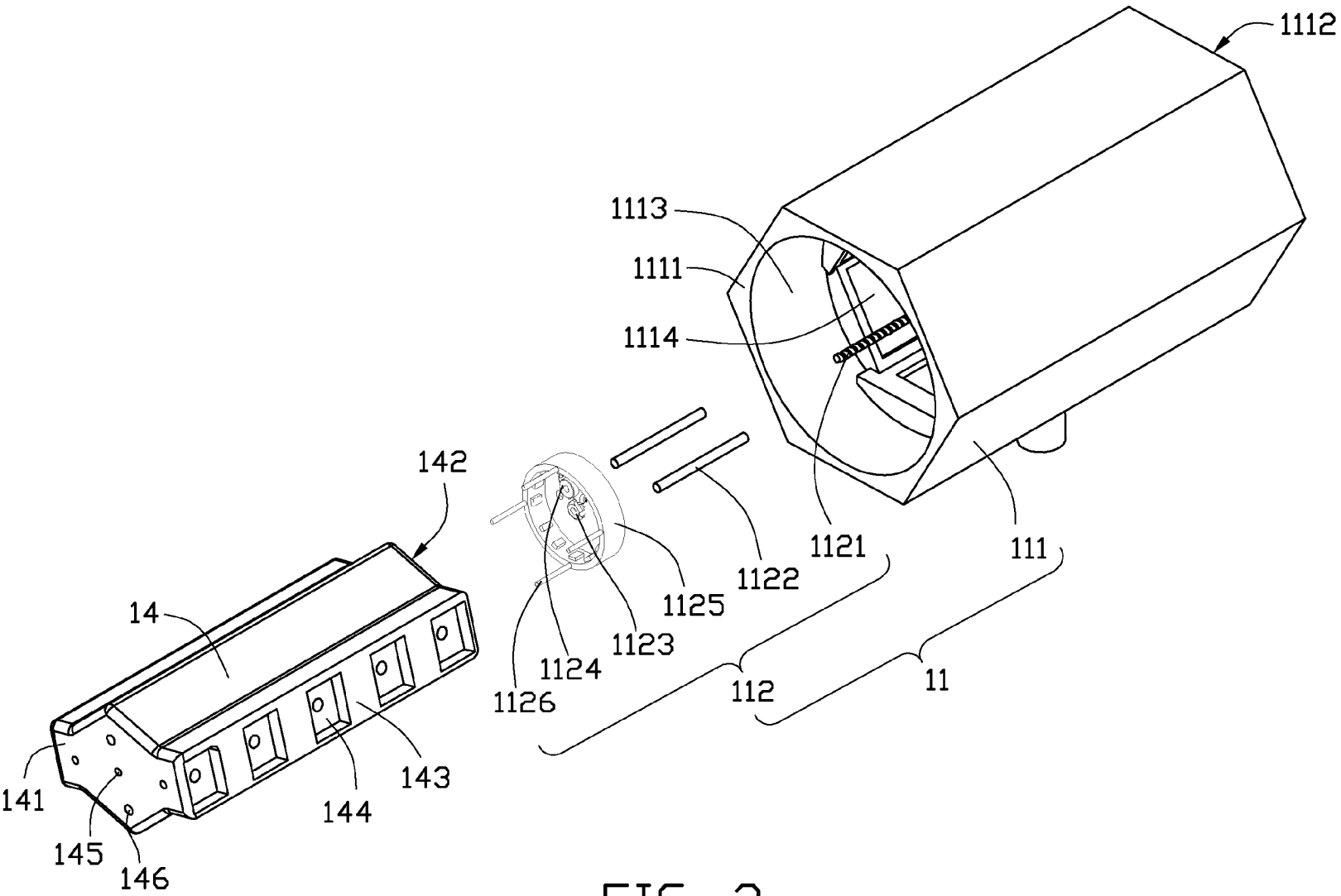
FIG. 3 is an exploded view of a cleaning member of the automatic cleaning apparatus of FIG. 1.

Referring to FIG. 1, an automatic cleaning apparatus 10 includes a cleaning member 11, a connecting member 12, a drying member 13, and a workpiece holder 14 (see FIG. 3). The cleaning member 11 and the drying member 13 are connected to two opposite sides of the connecting member 12 and can communicate with each other via the connecting member 12. The workpiece holder 14 receives and holds a plurality of workpieces to be cleaned. In the present embodiment, the workpiece holder 14 is a substrate holder, and the workpieces are substrates. The workpiece holder 14 can be received in the cleaning member 11, the connecting member 12 or the drying member 13 as and when required. In particular, the workpiece holder 14 moves between the cleaning member 11, the connecting member 12, and the drying member 13.

Figure 2:
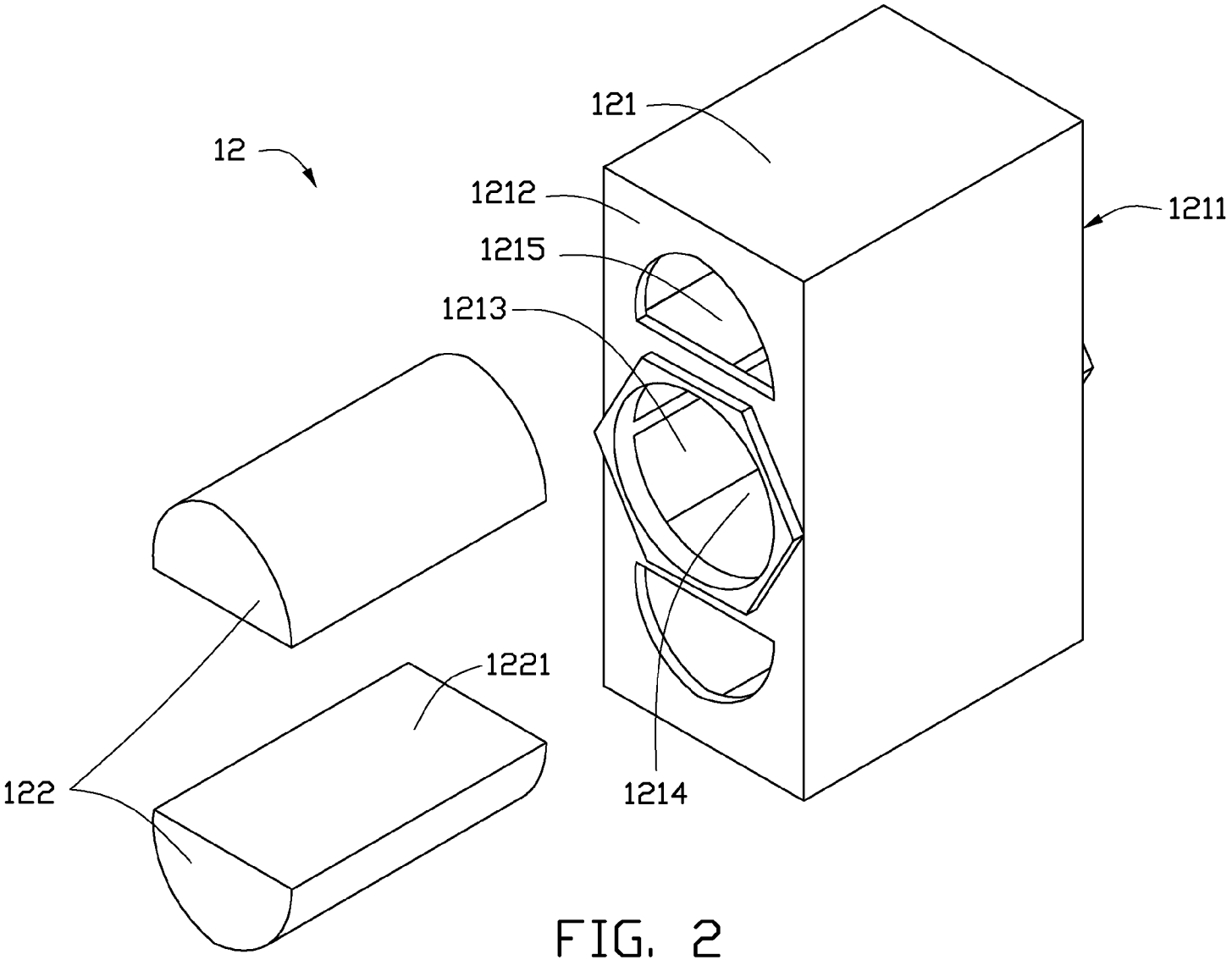
FIG. 2 is an exploded view of a connecting member of the automatic cleaning apparatus of FIG. 1.

Referring also to FIG. 2, the connecting member 12 includes a main housing 121 and two blocks 122 received in the main housing 121. The main housing 121 includes a first surface 1211 and a second surface 1212 at opposite sides thereof. The main housing 121 defines two first aligning holes 1213 (one not visible in FIG. 2) in the first surface 1211 and the second surface 1212, respectively, and a central first chamber 1214 with two ends thereof communicating with the two first aligning holes 1213. The main housing 121 further defines two second chambers 1215, which are above and below the first chamber 1214 and communicate with the first chamber 1214. Each second chamber 1215 extends through to the first surface 1211 and to a wall of the main housing 121 corresponding to the second surface 1212. The cleaning member 11 and the drying member 13 are aligned with the two first aligning holes 1213, respectively. Thus the cleaning member 11, the connecting member 12 and the drying member 13 communicate with each other through the first chamber 1214.

The two blocks 122 each are semicylindrical to fit into the two second chambers 1215. Each block 122 defines an engaging surface 1221, and the two engaging surfaces 1221 face each other. When the two blocks 122 move together in the first chamber 1214, the engaging surfaces 1221 engage with each other to prevent the cleaning member 11 and the drying member 13 from communicating with each other.

Referring to FIG. 3, the cleaning member 11 includes a first housing 111 and a driving mechanism 112 received in the first housing 111. The first housing 111 includes an inlet 113 and an outlet 114 (see FIG. 1).

The first housing 111 further includes a third surface 1111 facing the connecting member 12 and a fourth surface 1112 away from the connecting member 12. The third surface 1111 defines a second aligning hole 1113 aligning with the corresponding first aligning hole 1213, and the first housing 111 defines a cleaning cavity 1114 communicating with the first aligning hole 1213. The diameter of the second aligning hole 1113 is equal to that of the first aligning hole 1213. The first housing 111 is coupled to the main housing 121 and thereby the cleaning cavity 1114 communicates with the first chamber 1214. The inlet 113 and the outlet 114 protrude from a bottom surface of the first housing 111 between the third surface 1111 and the fourth surface 1112.

The driving mechanism 112 is received in the cleaning cavity 1114 of the first housing 111, and is coupled on an end wall of the first housing 111 which corresponds to the fourth surface 1112. The driving mechanism 112 includes a driving member (not shown), a rotary shaft 1121, two push rods 1122, a first gear 1123, a second gear 1124, and a third gear 1125. The first gear 1123 and the second gear 1124 are received in the third gear 1125. The first gear 1123 engages with the second gear 1124, and the second gear 1124 engages with the third gear 1125. The third gear 1125 includes a plurality of positioning pins 1126 protruding from a circumferential edge thereof facing the workpiece holder 14. The positioning pins 1126 are inserted into the workpiece holder 14. One end of the rotary shaft 1121 is connected to the driving member, and an opposite end of the rotary shaft 1121 passes through the third gear 1125 to be connected to the first gear 1123. A same end of each of the two push rods 1122 is connected to the driving member, and a same opposite end of each of the two push rods 1122 passes through the third gear 1125 to push the workpiece holder 14. While the driving member drives the rotary shaft 1121 to rotate, the first gear 1123, the second gear 1124 and the third gear 1125 transmit the rotation of the rotary shaft 1121 to the workpiece holder 14. The workpiece holder 14 moves in the cleaning member 11, with cleaning fluid being introduced into the cleaning cavity 1114 and cleaning the workpieces. The push rods 1122 can push the workpiece holder 14 away from the third gear 1125.

The workpiece holder 14 includes a fifth surface 141 and a sixth surface 142 at opposite sides thereof, and a side surface 143 therebetween. The fifth surface 141 and the sixth surface 142 each define a plurality of positioning holes 146 corresponding to the push pins 1126 of the third gear 1125. The side surface 143 defines a plurality of recesses 144 receiving the workpieces therein. The workpiece holder 14 defines a through hole 145 corresponding to the rotary shaft 1121. The through hole 145 extends through to both the fifth surface 141 and the sixth surface 142.

Figure 4:
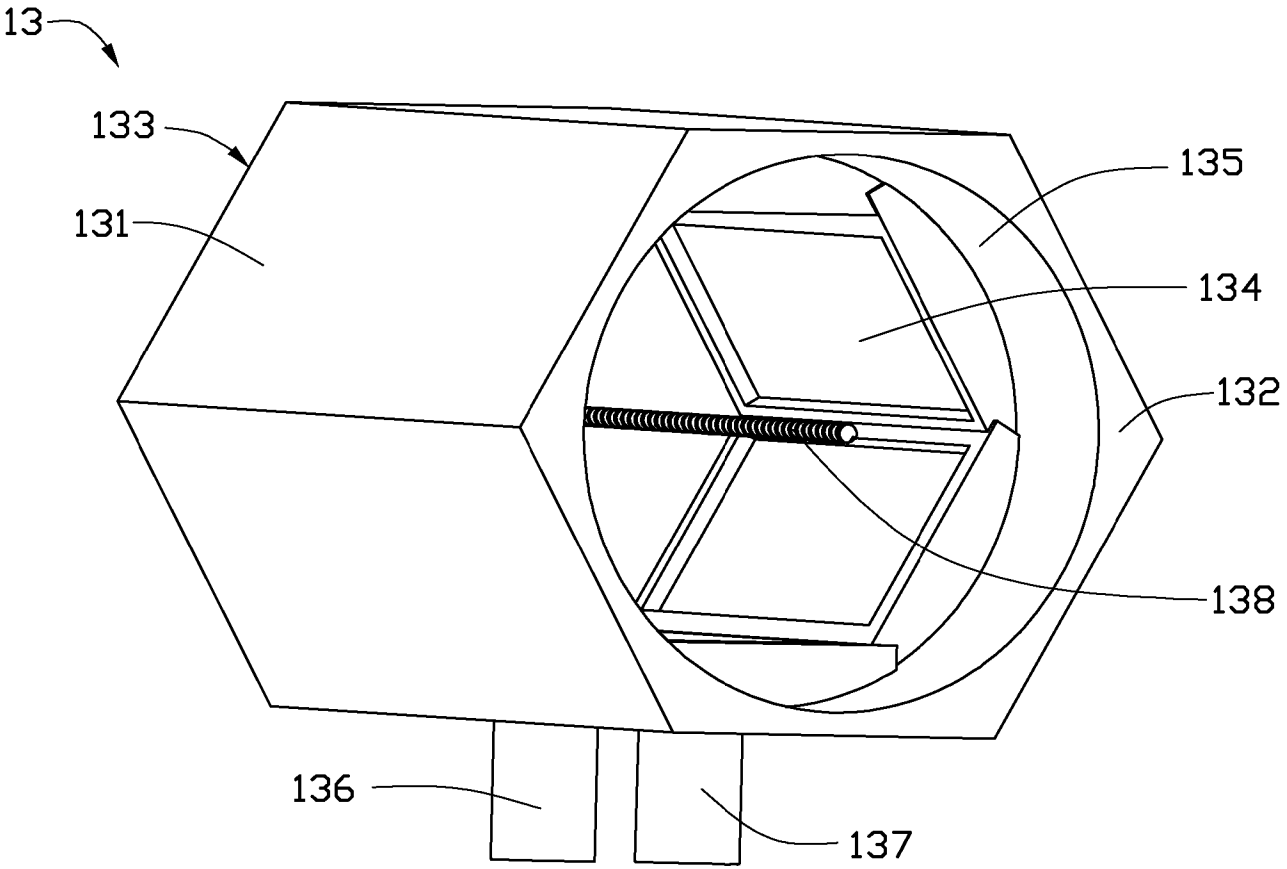
FIG. 4 is an isometric view of a drying member of the automatic cleaning apparatus of FIG. 1.

Referring also to FIG. 4, the structure of the drying member 13 is substantially similar to that of the cleaning member 11. The drying member 13 includes a second housing 131, and a driving mechanism (not shown) received in the second housing 131. The second housing 131 includes a seventh surface 132 facing the connecting member 12, and an eighth surface 133 away from the connecting member 12. The second housing 131 defines a drying cavity 134 and a third aligning hole 135 defined in the seventh surface 132. The third aligning hole 135 is aligned with the corresponding first aligning hole 1213 of the connecting member 12. The second housing 131 further includes an inlet 136 and an outlet 137, both communicating with the drying cavity 134.

The structure of the driving mechanism of the drying member 13 is substantially similar to that of the driving mechanism of the cleaning member 11. The driving mechanism of the drying member 13 includes a rotary shaft 138 corresponding to the through hole 145 of the workpiece holder 14. The rotary shaft 138 is aligned with the rotary shaft 1121 of the cleaning member 11. The driving mechanism can drive the workpiece holder 14 to rotate.

Figure 5:
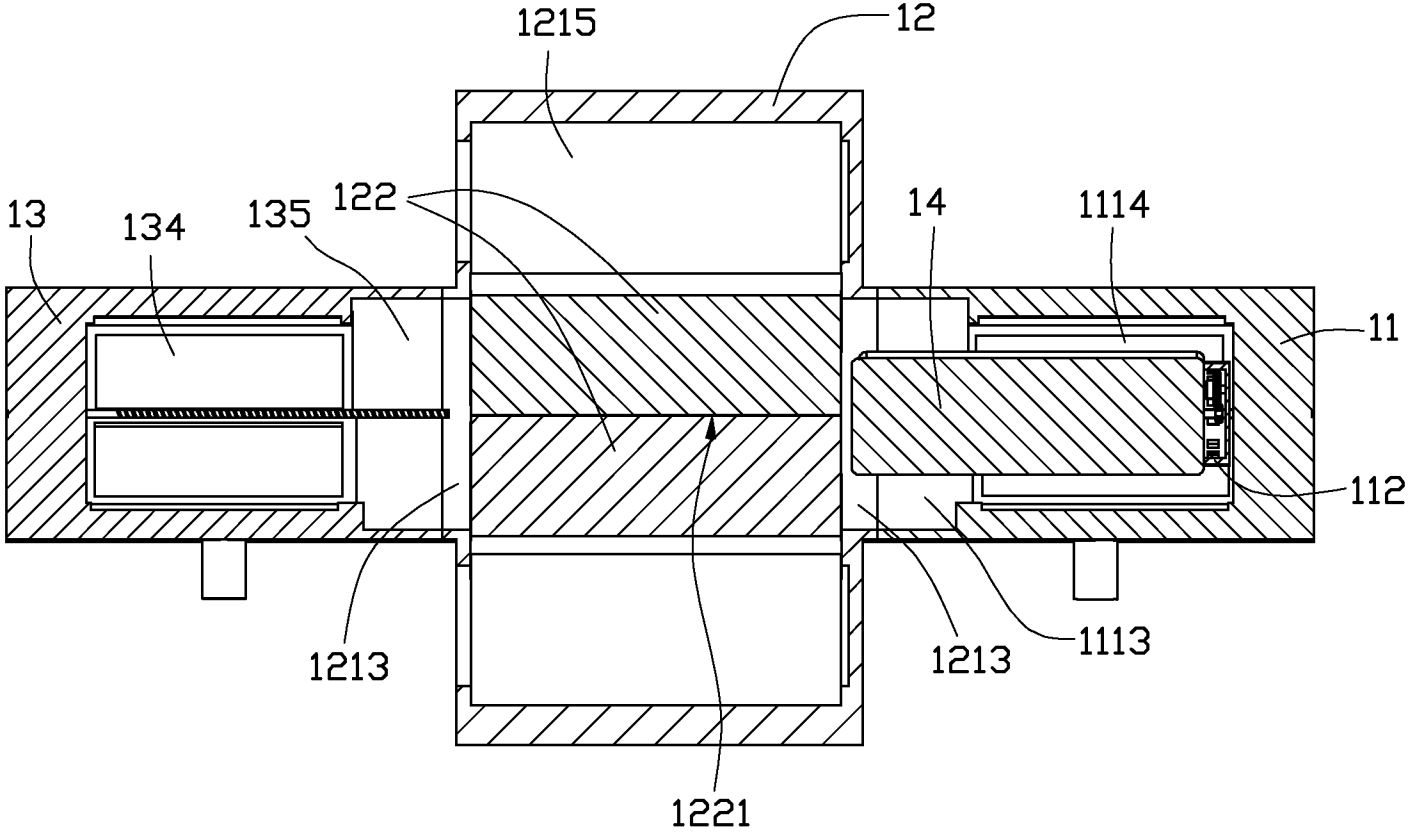
FIG. 5 is a first cross-sectional view of the automatic cleaning apparatus of FIG. 1, corresponding to line VI-VI of FIG. 1, and showing a workpiece holder received in the cleaning member.

Referring to FIG. 5, in initial operation of the automatic cleaning apparatus 10, after putting the workpieces into the recesses 144 of the workpiece holder 14, the workpiece holder 14 is received in the cleaning member 11. The cleaning member 11 is then attached to the connecting member 12. The two blocks 122 move together in the first chamber 1214, with the engaging surfaces 1221 engaging with each other. Thereby, the cleaning cavity 1114 and the drying cavity 134 are prevented from communicating with each other. The cleaning fluid is filled into the cleaning cavity 1114 through the inlet 113, and the driving mechanism 112 drives the workpiece holder 14 to rotate to clean the workpieces. After that, the used cleaning fluid can be expelled or drained out of the first housing 111 through the outlet 114.

Figure 6:
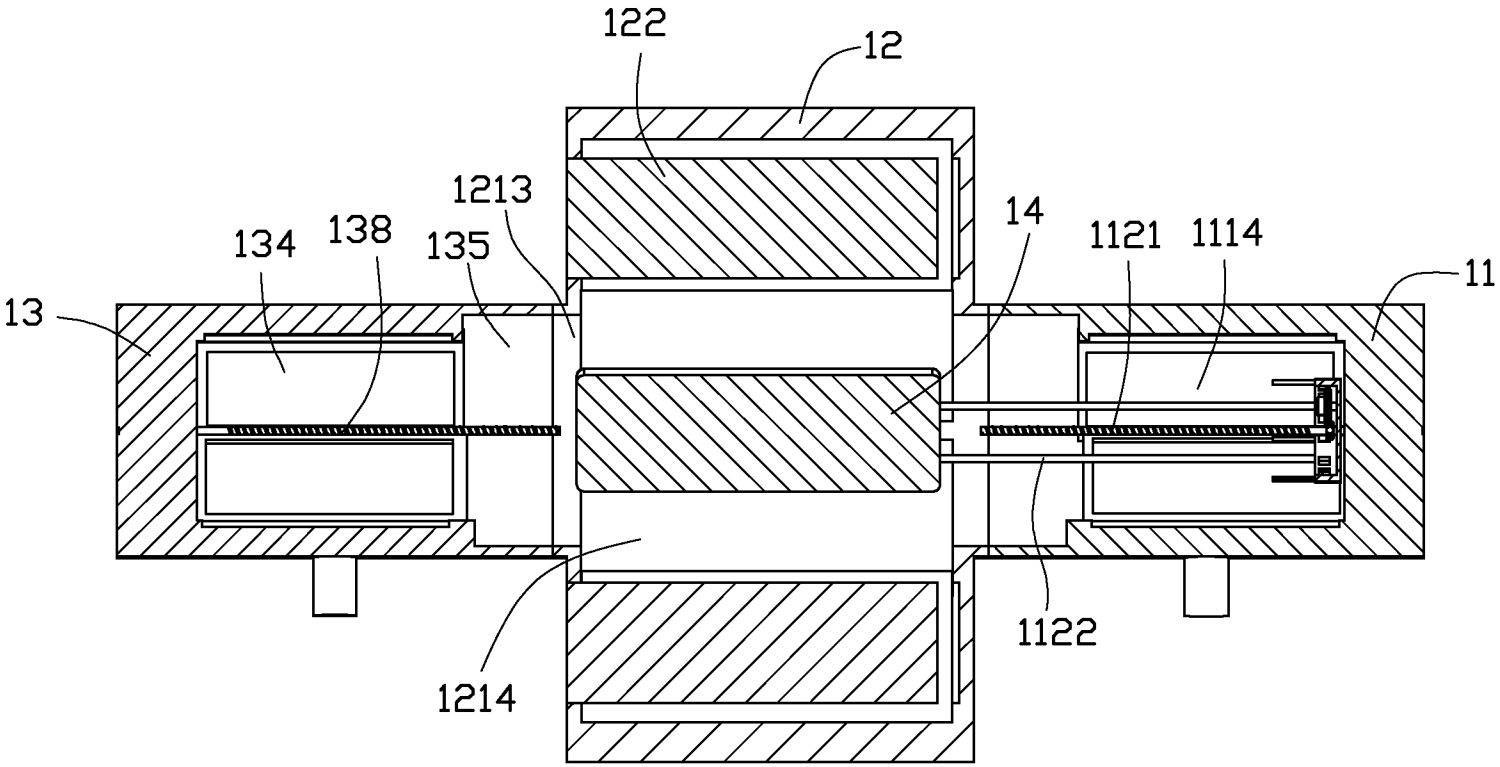
FIG. 6 is a second cross-sectional view of the automatic cleaning apparatus of FIG. 1, taken along line VI-VI of FIG. 1, and showing the workpiece holder of FIG. 5 received in the connecting member.

Referring to FIG. 6, the two blocks 122 then move into the two second chambers 1215 of the main housing 121. The push rods 1122 push the workpiece holder 14 into the first chamber 1214 of the connecting member 12.

Figure 7:
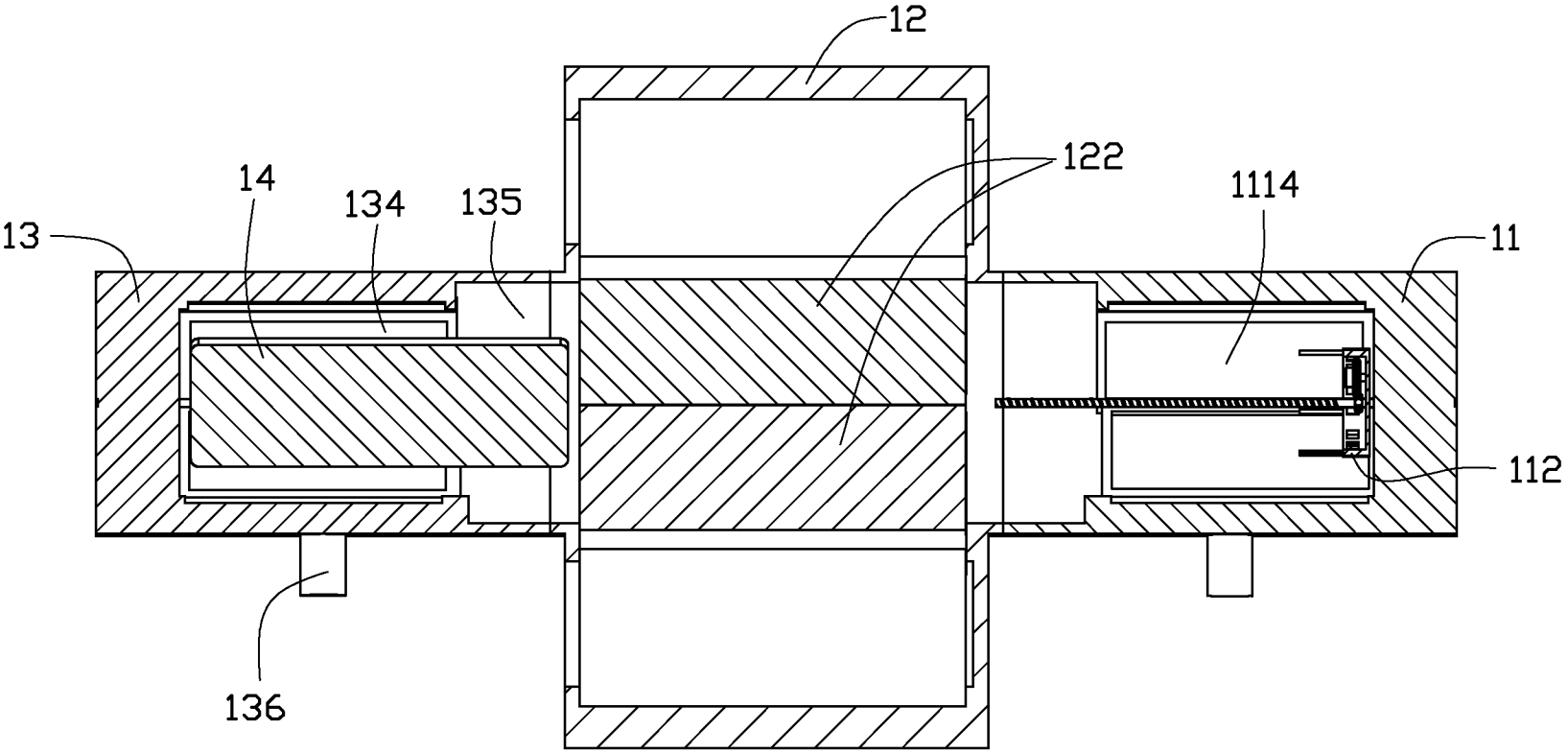
FIG. 7 is a third cross-sectional view of the automatic cleaning apparatus of FIG. 1, corresponding to line VI-VI of FIG. 1, and showing the workpiece holder of FIG. 5 received in the drying member.

Referring to FIG. 7, further pushed by the push rods 1122, the workpiece holder 14 is received in the drying cavity 134 of the drying member 13. After that, the two blocks 122 move together in the first chamber 1214. During this process, the rotary shaft 138 extends into and through the through hole 145 of the workpiece holder 14. The driving mechanism of the driving member drives the workpiece holder 14 to rotate and thereby remove (dislodge) used fluid still remaining on the workpieces. To shorten the processing time, air of a certain temperature can be filled into the second housing 131 of the drying member 13 through the inlet 136. The air can be expelled out of the second housing 131 through the outlet 137. After drying, the drying member 13 is detached from the connecting member 12 to enable the workpieces to be removed from the workpiece holder 14.

Finally, while the present disclosure has been described with reference to particular embodiments, the embodiments are illustrative and are not to be construed as limiting the disclosure. Therefore, various modifications can be made to the embodiments by those of ordinary skill in the art without departing from the true spirit and scope of the disclosure as defined by the appended claims and their equivalents.

What is claimed is:

1. An automatic cleaning apparatus for cleaning a plurality of workpieces, the automatic cleaning apparatus comprising:

a workpiece holder for receiving the workpieces;

a cleaning member defining a cleaning cavity for receiving the workpiece holder and cleaning the workpieces, and comprising a driving mechanism received in the cleaning cavity, wherein the driving mechanism comprises a driving member, a rotary shaft, at least one push rod, a first gear, a second gear, and a third gear, and two ends of the rotary shaft are respectively connected to the driving member and the first gear;

a drying member defining a drying cavity for receiving the workpiece holder and drying the workpieces, wherein, the push rods of the driving mechanism are arranged to be capable of pushing the workpiece holder from the cleaning member into the drying cavity of the drying member; and a connecting member comprising:

a main housing comprising:

two opposite surfaces;

a first chamber; and two second chambers each communicating with the first chamber, each of the second chambers extending through to one of the two opposite surfaces and to a wall of the main housing corresponding to the other one of the two opposite surfaces, wherein the cleaning member and the drying member are positioned to communicate with each other though the first chamber; and two blocks each movable between the first chamber and a respective one of the second chambers, each block defining an engaging surface, the engaging surfaces facing each other, wherein when the blocks move into the first chamber and the engaging surfaces engage with each other, the blocks prevent the cleaning member and the drying member from communicating with each other; the cleaning member and the drying member communicate with each other and the workpiece holder can move between the cleaning member and the drying member when the blocks move from the first chamber into the second chambers, respectively.

2. The automatic cleaning apparatus as described in claim 1, wherein the first housing comprises an inlet and an outlet configured for conveying fluid into and out of the first housing.

3. The automatic cleaning apparatus as described in claim 1, wherein the workpiece holder defines a plurality of positioning holes, and the third gear defines a plurality of positioning pins received in the positioning holes.

4. The automatic cleaning apparatus as described in claim 1, wherein the drying member comprises a second housing defining the drying cavity and a driving mechanism received in the second housing, the driving mechanism of the second housing comprises a driving member, a rotary shaft, a first gear, a second gear, and a third gear, and two ends of the rotary shaft are respectively connected to the driving member and the first gear; and when the driving member drives the rotary shaft to rotate, the first gear, the second gear and the third gear transmit the rotation of the rotary shaft to the workpiece holder.

5. The automatic cleaning apparatus as described in claim 4, wherein the second housing comprises an inlet and an outlet configured for conveying air into and out of the second housing.

6. A cleaning apparatus for automatically cleaning one or more workpieces, the cleaning apparatus comprising:

a workpiece holder for holding the workpieces;

a cleaning mechanism defining a cleaning cavity for receiving the workpiece holder and cleaning the workpieces, and comprising a driving mechanism received in the cleaning cavity, wherein the driving mechanism comprises a driving member, a rotary shaft, at least one push rod, a first gear, a second gear, and a third gear, and two ends of the rotary shaft are respectively connected to the driving member and the first gear;

a drying mechanism defining a drying cavity for receiving the workpiece holder and drying the workpieces, wherein, the push rods of the driving mechanism are capable of pushing the workpiece holder from the cleaning member into the drying cavity of the drying member; and a gate mechanism comprising:

a main housing comprising:

two opposite end walls;

a first chamber; and two second chambers above and below the first chamber and communicating with the first chamber, each of the second chambers extending through to the both of the two opposite end walls, wherein the cleaning mechanism and the drying mechanism are positioned adjacent to the two opposite end walls at the first chamber; and two blocks each movable between the first chamber and a respective one of the second chambers, each block defining an engaging face, wherein when the blocks are in the first chamber and the engaging faces engage with each other, the blocks shut off communication between the cleaning mechanism and the drying mechanism; the cleaning mechanism and the drying mechanism communicate with each other and the workpiece holder can move between the cleaning mechanism and the drying mechanism when the blocks move from the first chamber into the second chambers, respectively.

7. The cleaning apparatus as described in claim 6, wherein the first housing comprises an inlet and an outlet configured for conveying fluid into and out of the first housing.

8. The cleaning apparatus as described in claim 6, wherein the workpiece holder defines a plurality of positioning holes, and the third gear defines a plurality of positioning pins received in the positioning holes.

9. The cleaning apparatus as described in claim 6, wherein the drying mechanism comprises a second housing defining the drying cavity and a driving mechanism received in the second housing, the driving mechanism of the second housing comprises a driving member, a rotary shaft, a first gear, a second gear, and a third gear, and two ends of the rotary shaft are respectively connected to the driving member and the first gear; and when the driving member drives the rotary shaft to rotate, the first gear, the second gear and the third gear transmit the rotation of the rotary shaft to the workpiece holder.

10. The cleaning apparatus as described in claim 9, wherein the second housing comprises an inlet and an outlet configured for conveying air into and out of the second housing.

* * * * *